US005717974A

United States Patent [19]

Park

[11] Patent Number: 5,717,974

[45] Date of Patent: Feb. 10, 1998

[54] METHOD FOR MONITORING PRESCRIBED USE PERIODS OF REPLACEABLE PARTS WITHIN AN IMAGE FORMING APPARATUS

[75] Inventor: Jin-Sung Park, Daegu, Rep. of Korea

[73] Assignee: SamSung Electronics Co., Ltd., Suwon, Rep. of Korea

[21] Appl. No.: 655,025

[22] Filed: May 29, 1996

[30] Foreign Application Priority Data

May 31, 1995 [KR] Rep. of Korea ..... 14061/1995

[51] Int. Cl.[6] ..... G03G 15/00; G03G 21/00

[52] U.S. Cl. ..... 399/24; 399/43

[58] Field of Search ..... 355/208, 206, 355/204; 399/24, 43

[56] References Cited

U.S. PATENT DOCUMENTS

| | | | |
|---|---|---|---|
| 4,851,875 | 7/1989 | Tanimoto | 355/245 |
| 4,961,088 | 10/1990 | Gilliland et al. | 355/206 |
| 5,008,711 | 4/1991 | Sakamoto et al. | 355/206 |
| 5,021,828 | 6/1991 | Yamaguchi et al. | 355/209 |
| 5,066,978 | 11/1991 | Watarai et al. | 355/206 |
| 5,101,233 | 3/1992 | Ito et al. | 355/209 |
| 5,155,527 | 10/1992 | Gokita et al. | 355/204 |
| 5,200,779 | 4/1993 | Nawata | 355/206 |
| 5,206,685 | 4/1993 | Hara et al. | 355/206 |
| 5,208,626 | 5/1993 | Tanimoto et al. | 355/208 X |
| 5,223,895 | 6/1993 | Saitoh | 355/206 |
| 5,383,004 | 1/1995 | Miller et al. | 355/206 |
| 5,489,971 | 2/1996 | Nano | 355/208 |
| 5,546,163 | 8/1996 | Asai et al. | 355/204 |

*Primary Examiner*—Arthur T. Grimley
*Assistant Examiner*—Sophia S. Chen
*Attorney, Agent, or Firm*—Robert E. Bushnell, Esq.

[57] ABSTRACT

A method for monitoring prescribed use periods of replaceable parts within an image forming apparatus, contemplates the steps of: updating in a memory, current count values respectively corresponding to the replaceable parts in response to each printed sheet generated by the apparatus, each one of the current count values representing an amount of use sustained by a corresponding one of the replaceable parts; sequentially comparing the current count values with corresponding predetermined count values representative of the prescribed use periods to determine whether any one of the prescribed use periods has expired; and providing output of a printed document indicating that one of the prescribed use periods has expired when one of the current count values equals a corresponding one of the predetermined count values.

20 Claims, 3 Drawing Sheets

METHOD FOR MONITORING PRESCRIBED USE PERIODS OF REPLACEABLE PARTS WITHIN AN IMAGE FORMING APPARATUS

CROSS-REFERENCE TO RELATED APPLICATIONS

This application makes reference to, incorporates the same herein, and claims all benefits accruing under 35 U.S.C. §119 arising from an application for *Method For Monitoring Prescribed Use Periods Of Replaceable Parts Within An Image Forming Apparatus* earlier filed in the Korean Industrial Property Office on 31 May 1995 and there duly assigned Ser. No. 14061/1995.

BACKGROUND OF THE INVENTION

The present invention relates to a method for monitoring the prescribed use periods of a plurality of replaceable parts within an image forming apparatus, and more particularly, to a method for automatically providing output of printed reports indicating that specific parts within the image forming apparatus should be replaced or cleaned by sensing the amount of use sustained by the parts.

In order to ensure continuous high quality printing in an electrophotographic image forming apparatus, it is highly recommended that certain parts within the apparatus be replaced or cleaned after a prescribed amount of use. That is, to ensure high quality printing in a laser beam printer (LBP), light emitting diode (LED) printer, duplicator, facsimile, and other pans of an image forming apparatus such as a photosensitive drum, toner receptacle, and a developing unit should be replaced or cleaned after they have been used to generate a predetermined number of copies. Timely replacement of these parts improves copy quality and visibility, and also lengthens the operating life of the image forming apparatus.

In conventional image forming devices, however, it is often difficult for a user to determine how many printed copies have been produced. Moreover, since the prescribed use periods vary from part to part, the user can not always provide a timely replacement or cleaning of each part. As a result, them arises a problem in that image quality becomes deteriorated and the operating life of each part within the image forming apparatus is reduced.

Ideally, the user should be informed as to the expiration of the prescribed use periods of the replaceable pans as promptly as possible. Typically, this is facilitated through a message that is visually displayed on an operating panel of the image forming apparatus. U.S. Pat. No. 5,066,978 entitled *Image Forming Apparatus Having An Exchangeable Unit Exchange Timing Indicating Device* issued to Watarai et al., for example, discloses this type of conventional art.

I have found that this type of conventional visual indication, however, tends to be inadequate since it is usually displayed for only a short period of time, or can be easily cleared from the operating panel through a simple key input. Also, I have noticed that since the visually displayed message can only be viewed when in close proximity to the operating panel, users in an office environment can easily forget about the message when they are busily engaged in other office matters. Accordingly, I have discovered that there is a need to provide users with hard copies of messages indicating when each of the plurality of consumable parts within the image forming apparatus should be replaced.

SUMMARY OF THE INVENTION

Accordingly, it is an object of the present invention to provide an improved image forming apparatus and process.

It is another object to provide apparatus and a method for detecting the prescribed use periods of a plurality of replaceable parts within an electrophotographic image forming device.

It is yet another object to provide a method for informing a user when a plurality of replaceable parts within an electrophotographic image forming device should be replaced or cleaned.

It is still another object to provide a method for monitoring the prescribed use periods of a plurality of replaceable pans within an electrophotographic image forming apparatus and providing printed reports to a user to indicate when the prescribed use periods have expired.

To achieve these and other objects, the present invention provides a method for monitoring prescribed use periods of a plurality of replaceable parts within an image forming apparatus having a memory that stores predetermined count values representative of the prescribed use periods. The method contemplates updating in the memory, current count values respectively corresponding to the replaceable parts in response to each printed sheet generated by the apparatus, each one of the current count values represents an amount of use sustained by a corresponding one of the replaceable parts; sequentially comparing the current count values with corresponding predetermined count values to determine whether any one of the prescribed use periods has expired; and providing output of a printed document indicating that one of the prescribed use periods has expired when one of the current count values equals a corresponding one of the predetermined count values.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar elements components, wherein.

DETAILED DESCRIPTION OF THE INVENTION

Figure 1:
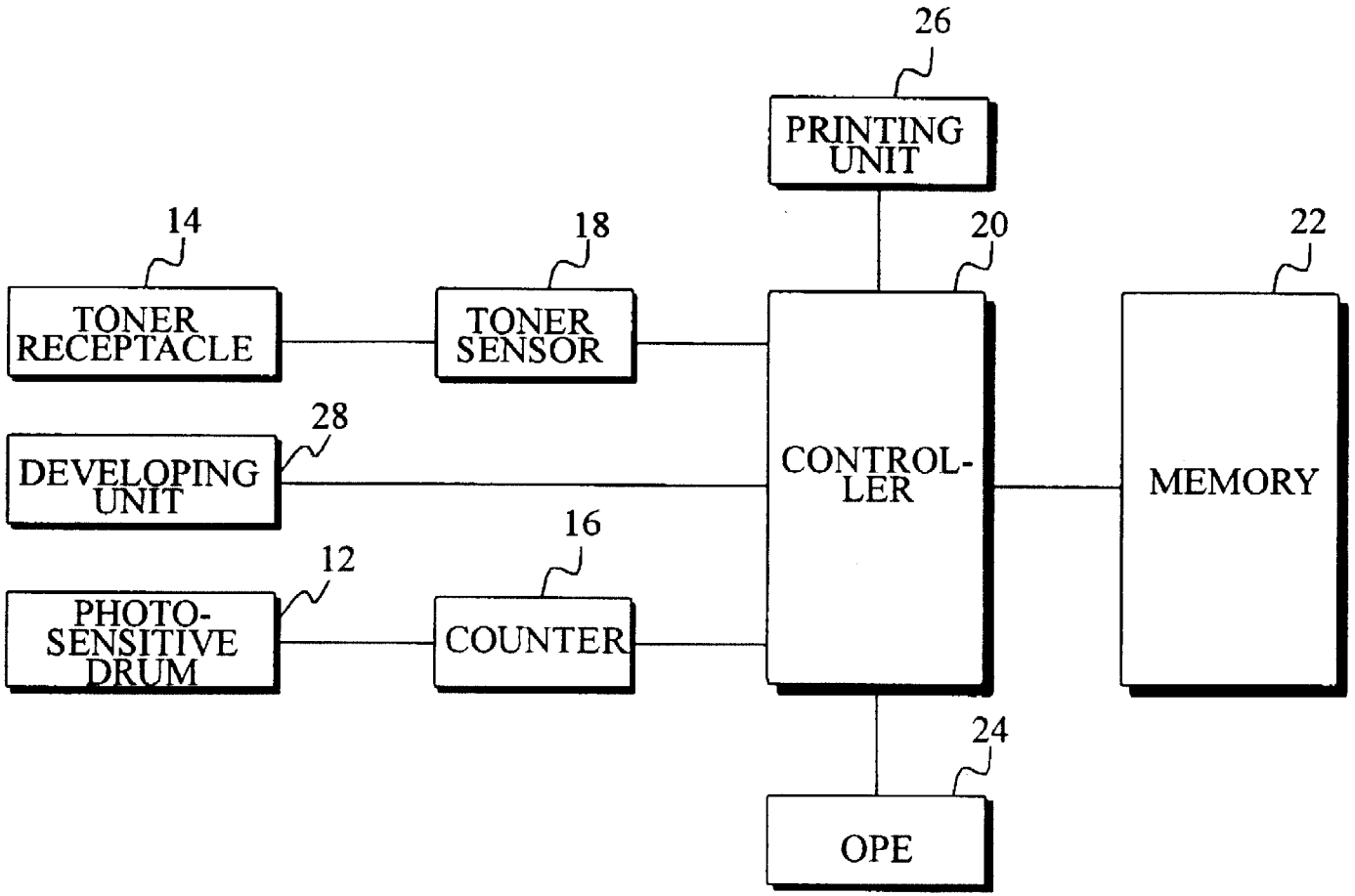
FIG. 1 is a block diagram illustrating an image forming apparatus constructed according to the principles of the present invention.

Turning now to the drawings and referring to FIG. 1, a block diagram illustrating an image forming apparatus constructed according to the principles of the present invention is shown. In FIG. 1, a photosensitive dram 12 is provided for forming an electrostatic latent image. A toner receptacle 14 stores toner and supplies the toner to the electrostatic latent image formed on photosensitive drum 12. A developing unit 28 performs a developing operation to develop the electrostatic latent image formed on photosensitive drum 12. A toner sensor 18 detects the amount of toner remaining in toner receptacle 14. A counter 16 generates a count value by counting the number of printed sheets that are generated by the apparatus, and is periodically initialized. A controller 20 updates a current count value for each of the replaceable pans within the apparatus in response to the count value provided from counter 16, and compares the updated count values with corresponding predetermined count values representative of the prescribed use periods of the replaceable pans. When any one of the updated count values is greater than or equal to a corresponding predetermined count value, controller 20 enables display of a message indicating that a corresponding one of the replaceable pans within the image forming apparatus should be replaced or cleaned, and also enables generation of a printed report indicating that the replaceable pan should be replaced or cleaned. A memory 22 is connected to controller 20 and stores a program that enables operation of controller 20. Memory 22 also stores the predetermined count values representative of the prescribed use periods for the replaceable pans within the apparatus, as well as, the current count values for the replaceable pans which are updated by controller 20 in response to each printed sheet generated by the apparatus. Operation panel equipment (hereinafter, "OPE") 24 includes menu keys, numeric keys, and various function keys, and displays the messages indicating that the replaceable parts within the apparatus should be replaced or cleaned under the control of controller 20. A printing unit 26 prints the reports (i.e., documents) indicating that the replaceable parts within the image forming apparatus should be replaced or cleaned under the control of controller 20.

In the image forming apparatus of FIG. 1, controller 20 sequentially compares the predetermined count values stored in memory 22 with the current count values in response to each printed sheet generated, to thereby determine whether any of the replaceable parts within the apparatus have reached the end of their prescribed use period, and therefore need to be replaced or cleaned.

Figure 2A:
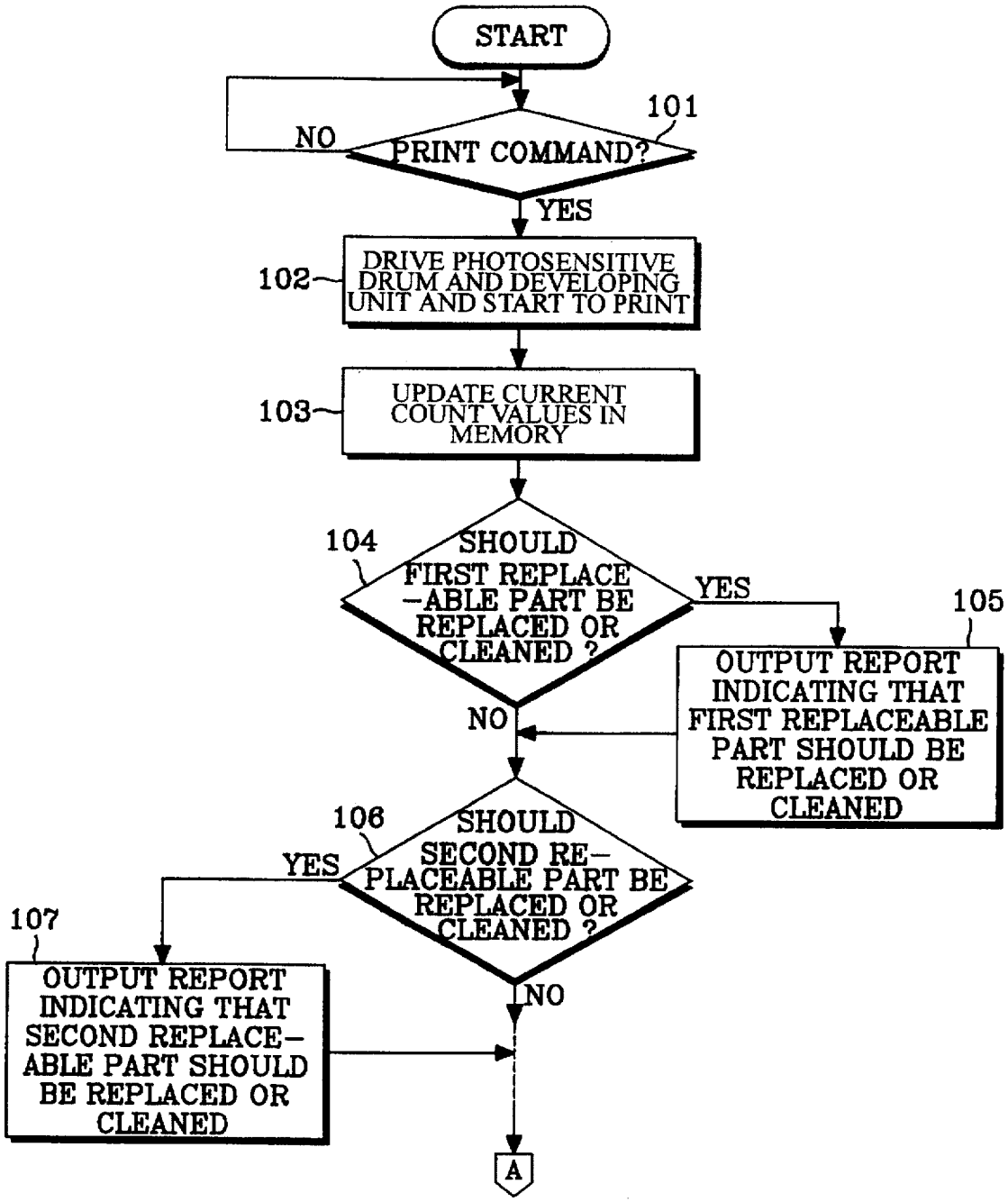
FIGS. 2A and 2B are flow charts illustrating control operations for enabling generation of printed reports indicating when various replaceable parts within the image forming apparatus should be replaced or cleaned according to the principles of the present invention.
Figure 2B:
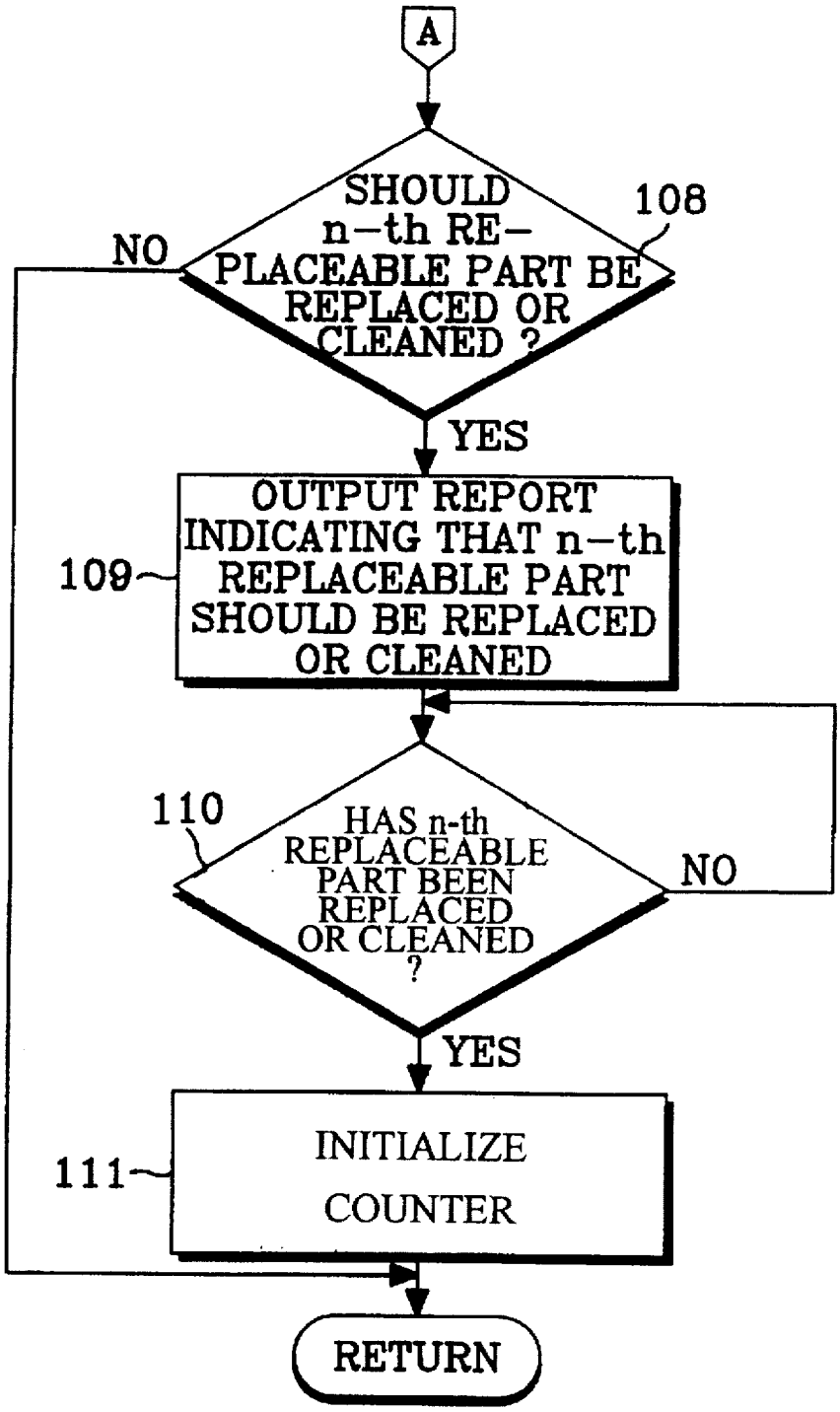

FIGS. 2A and 2B are flow charts illustrating control operations for enabling generation of printed reports indicating when various replaceable parts within the image forming apparatus should be replaced or cleaned according to the principles of the present invention. Briefly, the control operations include the steps of: updating the current count values for the replaceable parts in memory 22 in response to each printed sheet generated, comparing the updated count values with the corresponding predetermined count values representative of the prescribed use periods, and providing output of a printed document indicating that one of the replaceable parts should be replaced or cleaned when the part's updated count value is greater than or equal to its corresponding predetermined count value.

A detailed description of the operations of the present invention will now be provided with reference to FIGS. 1 through 2B.

During manufacture of the image forming apparatus constructed according to the principles of the present invention, the predetermined count values representative of the prescribed use periods of the various replaceable parts within the apparatus are stored in memory 22. In step 101, controller 20 determines whether a prim command is input from OPE 24. After the print command has been input, controller 20 proceeds to step 102 and drives photosensitive drum 12 and developing unit 28 and then prints image data via printing unit 26. In response to each print generated, counter 16 provides a count value to controller 20. Then, in step 103, controller 20 detects the number of printed sheets generated and updates the current count values for the various replaceable parts in memory 22. In step 104, controller 20 determines whether a first replaceable part has reached the end of its prescribed use period, and therefore should be replaced or cleaned, by comparing the updated count value corresponding to the first replaceable part with the predetermined count value representative of the first replaceable part's prescribed use period. If the updated count value corresponding to the first replaceable part equals or exceeds the predetermined count value representative of the first replaceable part's prescribed use period, the first replaceable part is deemed to have reached the end of its prescribed use period. Accordingly, controller 20 advances to step 105 and drives printing unit 26 to output a printed report indicating that the first replaceable part should be replaced or cleaned. In step 104 however, if the first replaceable part has not reached the end of its prescribed use period, controller advances to step 106 and detects whether a second replaceable part has reached the end of its prescribed use period, and therefore should be replaced or cleaned. This determination is made by comparing the updated count value corresponding to the second replaceable part with the predetermined count value representative of the second replaceable part's prescribed use period. If the updated count value corresponding to the second replaceable part equals or exceeds the predetermined count value representative of the second replaceable part's prescribed use period, the second replaceable part is deemed to have reached the end of its prescribed use period. Accordingly, controller 20 advances to step 107 and drives printing unit 26 to output a printed report indicating that the second replaceable part should be replaced or cleaned. In step 106 however, if the second replaceable part has not reached the end of its prescribed use period, controller 20 advances to step 108 and determines whether an n-th replaceable part has reached the end of its prescribed use period. Again, this determination is made by comparing the updated count value corresponding to the n-th replaceable part with the predetermined count value representative of the n-th replaceable part's prescribed use period. If the updated count value corresponding to the n-th replaceable part equals or exceeds the predetermined count value representative of the n-th replaceable part's prescribed use period, the n-th replaceable part is deemed to have reached the end of its prescribed use period. Accordingly, controller 20 advances to step 109 and drives printing unit 26 to output a printed report indicating that the n-th replaceable part should be replaced or cleaned.

In step 110, controller 20 detects whether the n-th replaceable part has been replaced or cleaned. Once this has been performed, counter 16 is initialized in step 111, and the apparatus returns to its general mode of operation.

In the preferred embodiment of the present invention, a printed report indicating that a corresponding replaceable part should be replaced or cleaned is provided to the user. It is also contemplated, however, that an audible warning sound and/or a variable visual display of the message on OPE 24 accompany the printed report. This helps ensure that the user receives the information necessary to facilitate the replacement or cleaning of the given parts. Also, the n-th designation is used in the above description to indicate that the method of the present invention can be performed for however many replaceable parts exist within the image forming apparatus. The practice of the present invention contemplates use of photosensitive drum 12, developing unit 28 and toner receptacle 14 as replaceable parts.

As set forth in the foregoing the present invention provides a method for accurately detecting prescribed use periods for a plurality of replaceable parts within an image forming apparatus. Since the user receives maintenance information for all of the replaceable parts within the apparatus, image quality can be improved and the management of each part within the image forming apparatus is accurately achieved.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A method for monitoring prescribed use periods of replaceable parts within an image forming apparatus having a memory that stores predetermined count values representative of said prescribed use periods, said method comprising the steps of:

updating in said memory, current count values respectively corresponding to said replaceable parts in response to each printed sheet generated by said apparatus, each one of said current count values representing an amount of use sustained by a corresponding one of said replaceable parts;

sequentially comparing said current count values with corresponding said predetermined count values to determine whether any one of said prescribed use periods has expired; and providing output of a printed document indicating that one of said prescribed use periods has expired when one of said current count values equals a corresponding one of said predetermined count values.

2. The method as claimed in claim 1, wherein said replaceable parts are comprised of a photosensitive drum, a developing unit and a toner receptacle.

3. The method as claimed in claim 2, further comprising a step of providing, in conjunction with said printed document, an audible sound and a variable visual display indicating that said one of said prescribed use periods has expired.

4. The method of claim 1, further comprised of providing said printed document for a first one of the replaceable parts, independently of whether any of said current count values for other ones of the replaceable parts have equaled or exceeded corresponding ones of said predetermined count values.

5. A method for monitoring prescribed use periods of replaceable parts within an image forming apparatus, said method comprising the steps of:

updating in a memory, current count values respectively corresponding to said replaceable parts in response to each printed sheet generated by said apparatus, each one of said current count values representing an amount of use sustained by a corresponding one of said replaceable parts;

sequentially comparing said current count values with corresponding predetermined count values representative of said prescribed use periods to determine whether any one of said prescribed use periods has expired; and providing output of a printed document and an audible message indicating that one of said prescribed use periods has expired when one of said current count values equals a corresponding one of said predetermined count values.

6. The method as claimed in claim 5, wherein said replaceable parts are comprised of a photosensitive drum, a developing unit and a toner receptacle.

7. A method for monitoring prescribed use periods of replaceable parts within an image forming apparatus, said method comprising the steps of:

detecting input of a print command;

performing a print operation in response to the detection of said print command;

updating current count values stored in a memory in response to each printed sheet generated by said apparatus, each one of said current count values representing an amount of use sustained by a corresponding one of said replaceable parts;

comparing a first one of said current count values with a first predetermined count value representative of a first one of said prescribed use periods;

generating a first printed document indicating that a first one of said replaceable parts should be replaced or cleaned, when said first one of said current count values equals or exceeds said first predetermined count value;

comparing a second one of said current count values with a second predetermined count value representative of a second one of said prescribed use periods, when said first one of said current count values does not equal or exceed said first predetermined count value;

generating a second printed document indicating that a second one of said replaceable parts should be replaced or cleaned, when said second one of said current count values equals or exceeds said second predetermined count value;

comparing a third one of said current count values with a third predetermined count value representative of a third one of said prescribed use periods, when said second one of said current count values does not equal or exceed said second predetermined count value; and generating a third printed document indicating that a third one of said replaceable parts should be replaced or cleaned, when said third one of said current count values equals or exceeds said third predetermined count value.

8. The method as claimed in claim 7, wherein said replaceable parts are comprised of a photosensitive drum, a developing unit and a toner receptacle.

9. The method as claimed in claim 7, further comprising a step of determining whether said third one of said replaceable parts has been replaced or cleaned after said step of generating said third printed document.

10. The method as claimed in claim 9, further comprising a step of initializing a counter used to update of said current count values after said third one of said replaceable parts has been replaced or cleaned.

11. The method as claimed in claim 10, wherein said replaceable parts are comprised of a photosensitive drum, a developing unit and a toner receptacle.

12. The method of claim 7, further comprised of:

comparing a second one of said current count values with a second predetermined count value representative of a second one of said prescribed use periods, when said first one of said current count values equals or exceeds said first predetermined count value; and generating a second printed document indicating that a second one of said replaceable parts should be replaced or cleaned, when said second one of said current count values equals or exceeds said second predetermined count value.

13. The method of claim 12, further comprised of:

comparing a third one of said current count values with a third predetermined count value representative of a third one of said prescribed use periods, when said first one of said current count values equals or exceeds said first predetermined count value; and generating a third printed document indicating that a third one of said replaceable parts should be replaced or cleaned, when said third one of said current count values equals or exceeds said second predetermined count value.

14. The method of claim 12, further comprised of:

comparing a third one of said current count values with a third predetermined count value representative of a third one of said prescribed use periods, when said second one of said current count values equals or exceeds said second predetermined count value; and generating a third printed document indicating that a third one of said replaceable parts should be replaced or cleaned, when said third one of said current count values equals or exceeds said second predetermined count value.

15. The method of claim 7, further comprised of:

comparing a third one of said current count values with a third predetermined count value representative of a third one of said prescribed use periods, when said first one of said current count values equals or exceeds said first predetermined count value; and generating a third printed document indicating that a third one of said replaceable parts should be replaced or cleaned, when said third one of said current count values equals or exceeds said second predetermined count value.

16. The method of claim 7, further comprised of:

comparing a third one of said current count values with a third predetermined count value representative of a third one of said prescribed use periods, when said second one of said current count values equals or exceeds said second predetermined count value; and generating a third printed document indicating that a third one of said replaceable parts should be replaced or cleaned, when said third one of said current count values equals or exceeds said second predetermined count value.

17. An image forming apparatus, comprising:

a plurality of replaceable parts;

a memory for storing predetermined count values representative of prescribed use periods for said plurality of replaceable parts, and current count values representative of a current amount of use sustained by said plurality of replaceable parts;

a counter for generating a count value in response to each printed sheet generated by said apparatus; and a controller for receiving said count value from said counter, updating said current count values stored in said memory in response to each said printed sheet generated by said apparatus, sequentially comparing said current count values with corresponding said predetermined count values to determine whether any one of said prescribed use periods has expired, and enabling output of a printed document indicating that one of said prescribed use periods has expired when one of said current count values equals a corresponding one of said predetermined count values.

18. The image forming apparatus as claimed in claim 17, wherein said plurality of replaceable parts comprises a photosensitive drum, a toner receptacle and a developing unit.

19. A method for monitoring prescribed use periods of replaceable parts within an image forming apparatus, said method comprising the steps of:

detecting input of a print command;

performing a print operation in response to the detection of said print command;

incrementally changing current count values stored in a memory in response to each printed sheet generated by said apparatus, each one of said current count values representing an amount of use sustained by a corresponding one of said replaceable parts;

comparing a first one of said current count values with a first predetermined count value representative of a first one of said prescribed use periods;

generating a first printed document and a first audible message indicating that a first one of said replaceable parts should be replaced or cleaned, when said first one of said current count values equals or exceeds said first predetermined count value;

comparing a second one of said current count values with a second predetermined count value representative of a second one of said prescribed use periods, independently of whether said first one of said current count values equal or exceed said first predetermined count value;

generating a second printed document and a second audible message indicating that a second one of said replaceable parts should be replaced or cleaned, when said second one of said current count values equals or exceeds said second predetermined count value;

comparing a third one of said current count values with a third predetermined count value representative of a third one of said prescribed use periods, independently of whether said second one of said current count values equal or exceed said second predetermined count value; and generating a third printed document and a third audible message indicating that a third one of said replaceable parts should be replaced or cleaned, when said third one of said current count values equals or exceeds said third predetermined count value.

20. The method as claimed in claim 19, wherein said replaceable parts are comprised of a photosensitive drum, a developing unit and a toner receptacle.

* * * * *